US009293100B2

(12) United States Patent
Pyun et al.

(10) Patent No.: US 9,293,100 B2
(45) Date of Patent: Mar. 22, 2016

(54) DISPLAY APPARATUS AND METHOD OF DRIVING THE SAME

(75) Inventors: Kihyun Pyun, Goyang-si (KR); Sung-In Kang, Asan-si (KR); Sedae Ki, Daegu (KR); Seung-Woon Shin, Asan-si (KR); Hyeongseop Im, Daegu (KR); Jun-Ho Hwang, Asan-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 272 days.

(21) Appl. No.: 13/545,431

(22) Filed: Jul. 10, 2012

(65) Prior Publication Data

US 2013/0215160 A1 Aug. 22, 2013

(30) Foreign Application Priority Data

Feb. 22, 2012 (KR) ..... 10-2012-0018066

(51) Int. Cl.
*G09G 3/36* (2006.01)

(52) U.S. Cl.
CPC ..... *G09G 3/3655* (2013.01); *G09G 2300/0426* (2013.01); *G09G 2310/0205* (2013.01)

(58) Field of Classification Search
CPC ..... G09G 2300/0426; G09G 2310/0205; G09G 3/3655; G09G 3/3696; G09G 3/3674; G09G 2320/02765
USPC ..... 345/690, 98, 99, 204
See application file for complete search history.

(56) References Cited

U.S. PATENT DOCUMENTS

| | | | | |
|---|---|---|---|---|
| 6,803,895 | B2 | 10/2004 | Knapp et al. | |
| 2004/0246219 | A1* | 12/2004 | Moon | 345/89 |
| 2008/0024418 | A1* | 1/2008 | Kim | 345/98 |
| 2008/0024689 | A1* | 1/2008 | Ahn | 349/43 |
| 2008/0136809 | A1 | 6/2008 | Lee et al. | |
| 2008/0198122 | A1* | 8/2008 | Shin et al. | 345/94 |
| 2009/0073154 | A1* | 3/2009 | Lee et al. | 345/211 |
| 2010/0073354 | A1* | 3/2010 | Kim et al. | 345/213 |
| 2010/0156954 | A1* | 6/2010 | Kim et al. | 345/690 |

FOREIGN PATENT DOCUMENTS

| | | | |
|---|---|---|---|
| JP | 2007178952 | A | 7/2007 |
| KR | 1019880005766 | A | 6/1988 |
| KR | 1020000069643 | A | 11/2000 |
| KR | 1020030068632 | A | 8/2003 |
| KR | 1020050007831 | A | 1/2005 |
| KR | 1020070068096 | A | 6/2007 |
| KR | 1020070068098 | A | 6/2007 |
| KR | 1020070082232 | A | 8/2007 |
| KR | 1020080083883 | A | 9/2008 |
| KR | 1020100083250 | A | 7/2010 |

* cited by examiner

*Primary Examiner* — Koosha Sharifi-Tafreshi
*Assistant Examiner* — Chun-Nan Lin
(74) *Attorney, Agent, or Firm* — Cantor Colburn LLP

(57) ABSTRACT

A display apparatus includes pixels connected to gate lines and data lines crossing the gate lines, a data driver which drives the data lines, a gate driver which drives the gate lines, a timing controller which controls the data driver and the gate driver in response to an image signal and a control signal and outputs a first kickback signal and a second kickback signal, and a voltage generator which outputs a first gate-on voltage and a second gate-on voltage in response to the first and second kickback signals to drive the gate lines. The gate driver drives a first group of gate lines in response to the first gate-on voltage and drives a second group of the gate lines in response to the second gate-on voltage.

19 Claims, 9 Drawing Sheets

DISPLAY APPARATUS AND METHOD OF DRIVING THE SAME

This application claims priority to Korean Patent Application No. 10-2012-0018 066, filed on Feb. 22, 2012, and all the benefits accruing therefrom under 35 U.S.C. §119, the content of which in its entirety is herein incorporated by reference.

BACKGROUND

1. Field

The disclosure relates to a display apparatus and a method of driving the same. More particularly, the disclosure relates to a display apparatus and a method of driving the same capable of improving display quality.

2. Description of the Related Art

In general, a display apparatus includes a display panel that displays an image, and gate and data drivers that drive the display panel. The display panel includes a plurality of gate lines, a plurality of data lines, and a plurality of sub-pixels. Each sub-pixel includes a thin film transistor, a liquid crystal capacitor, and a storage capacitor. The data driver applies gray scale voltages to the data lines and the gate driver applies gate signals to the gate lines to drive the gate lines.

When a gate-on voltage is applied to a gate electrode of the thin film transistor of the sub-pixel connected to a corresponding gate line, a data voltage corresponding to a desired image is applied to a source electrode of the thin film transistor through a corresponding data line, thereby displaying the desired image. The data voltage applied to the liquid crystal capacitor and the storage capacitor of the sub-pixel through the turned-on thin film transistor is required to be maintained during a predetermined time period after the thin film transistor is turned off. However, due to a parasitic capacitance formed between gate and drain electrodes of the thin film transistor, the data voltage applied to the liquid crystal capacitor and the storage capacitor can be distorted.

The distorted voltage is called a kickback voltage. As the kickback voltage is increased, image trembling occurs due to variation of an image quality between frames. In general, when the gate-on voltage is decreased, the kickback voltage is lowered. However, a driving capability of the thin film transistor can be degraded when the gate-on voltage is decreased.

SUMMARY

The disclosure provides a display apparatus and a method of driving the same capable of preventing a driving capability of a thin film transistor from being degraded.

Embodiments of the invention provide a display apparatus including a plurality of gate lines, a plurality of data lines which cross the plurality of the gate lines, a plurality of pixels which is connected to the plurality of the gate lines and the plurality of the data lines, a data driver which drives the plurality of the data lines, a gate driver which drives the plurality of the gate lines, a timing controller which controls the data driver and the gate driver in response to an image signal and a control signal and outputs a first kickback signal and a second kickback signal, and a voltage generator which outputs a first gate-on voltage and a second gate-on voltage in response to the first and second kickback signals, wherein the first gate-on voltage and the second gate-on voltage drive the plurality of the gate lines. The gate driver drives a first group of gate lines in response to the first gate-on voltage and drives a second group of the gate lines in response to the second gate-on voltage.

In an exemplary embodiment, the voltage generator may generate the first gate-on voltage in response to the first kickback signal and generate the second gate-on voltage in response to the second kickback signal.

In an exemplary embodiment, the voltage generator may include a first gate-on voltage generator which generates the first gate-on voltage in response to the first kickback signal and a second gate-on voltage generator which generates the second gate-on voltage in response to the second kickback signal.

In an exemplary embodiment, the first gate-on voltage generator may further include a regulator which generates a gate-on voltage.

In an exemplary embodiment, the first gate-on voltage generator may include a first logic circuit which receives the first kickback signal and a voltage level signal and outputs a first kickback enable signal, a first transistor connected between the gate-on voltage and a first node and including a gate controlled by the first kickback signal, and a second transistor connected between the first node and a second node and including a gate controlled by the first kickback enable signal.

In an exemplary embodiment, the second gate-on voltage generator may include a second logic circuit which receives the second kickback signal and the voltage level signal and outputs a second kickback enable signal, a third transistor connected between the gate-on voltage and a third node and including a gate controlled by the second kickback signal, and a fourth transistor connected between the third node and the second node and including a gate controlled by the second kickback enable signal.

In an exemplary embodiment, the timing controller may further output the voltage level signal.

In an exemplary embodiment, the voltage generator may further include a resistor connected between the second node and a ground voltage.

In an exemplary embodiment, the first group of the gate lines may include odd-numbered gate lines and the second group of the gate lines may include even-numbered gate lines.

In an exemplary embodiment, the first kickback signal may have a frequency identical to a frequency of the second kickback signal and have a phase different from a phase of the second kickback signal.

In an exemplary embodiment, the plurality of the pixels may include a red pixel, a green pixel, and a blue pixel, which extend in a direction substantially parallel to the gate lines, a first group of pixels may be connected to a data line at a left side thereof, and a second group of the pixels may be connected to a data line at a right side thereof.

In an exemplary embodiment, the first group of the pixels may be alternately arranged with the second group of the pixels in a direction in which the plurality of the data lines extend.

In an exemplary embodiment, the gate lines may be driven such that data lines connected to a next gate line are pre-charged when pixels connected to a current gate line are applied with a data signal.

Embodiments of the invention also provide a method of driving a display apparatus, the method including controlling a data driver and a gate driver in response to an image signal and a control signal and outputting a first kickback signal and a second kickback signal; and outputting a first gate-on voltage and a second gate-on voltage in response to the first and second kickback signals, respectively, wherein a first group of gate lines is driven in response to the first gate-on voltage and a second group of the gate lines is driven in response to the second gate-on voltage, and wherein the display apparatus includes a plurality of gate lines comprising the first and second group of gate lines; a plurality of data lines which cross the plurality of the gate lines; a plurality of pixels connected to the plurality of the gate lines and the plurality of the data lines; the data driver which drives the plurality of the data lines; and the gate driver which drives the plurality of the gate lines.

In an exemplary embodiment, the first group of the gate lines may include odd-numbered gate lines and the second group of the gate lines may include even-numbered gate lines.

In an exemplary embodiment, the outputting the first kickback signal and the second kickback signal may include outputting the first kickback signal having a frequency identical to a frequency of the second kickback signal and having a phase different from a phase of the second kickback signal.

In an exemplary embodiment, the plurality of the pixels may include a red pixel, a green pixel, and a blue pixel, which extend in a direction substantially parallel to the gate lines, and the method may further include connecting a first group of pixels to a data line at a left side thereof; and connecting a second group of pixels to a data line at a right side thereof.

In an exemplary embodiment, the method may further include alternately arranging the first group of the pixels and the second group of the pixels in a direction in which the plurality of the data lines extend.

In an exemplary embodiment, the method may further include driving the gate lines such that data lines connected to a next gate line are pre-charged when pixels connected to a current gate line are applied with a data signal.

BRIEF DESCRIPTION OF THE DRAWINGS

The above and other aspects, advantages and features of the invention will become readily apparent by reference to the following detailed description when considered in conjunction with the accompanying drawings wherein.

DETAILED DESCRIPTION

Figure 1:
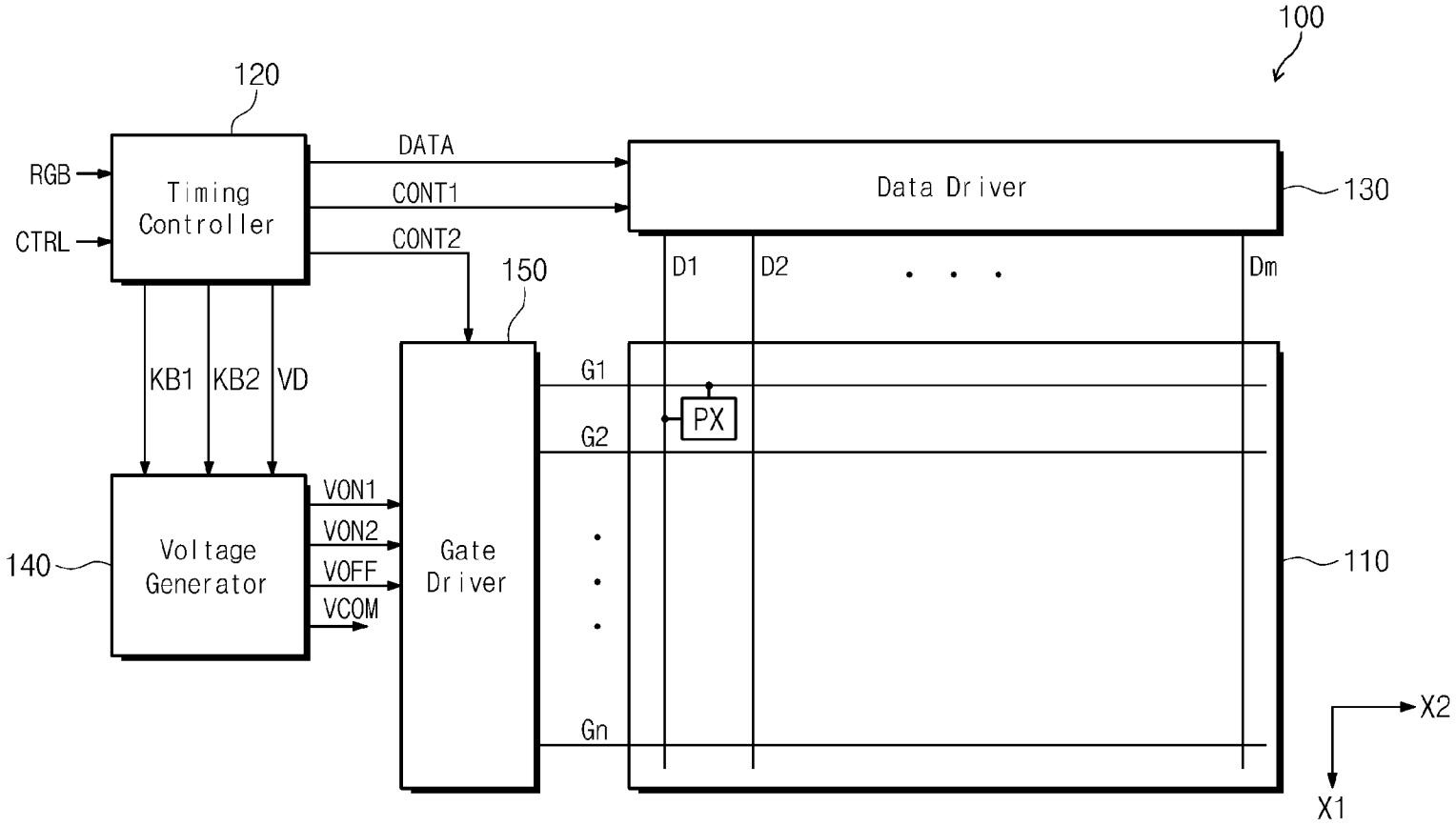
FIG. 1 is a block diagram showing an exemplary embodiment of a display apparatus according to the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or"includes any and all combinations of one or more of the associated listed items.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

FIG. 1 is a block diagram showing an exemplary embodiment of a display apparatus according to the invention.

Referring to FIG. 1, a display apparatus 100 includes a display panel 110, a timing controller 120, a data driver 130, a voltage generator 140, and a gate driver 150.

The display panel 110 includes a plurality of data lines D1 to Dm extended in a first direction X1, a plurality of gate lines G1 to Gn extended in a second direction X2 to cross the data lines D1 to Dm, and a plurality of sub-pixels PX arranged in a matrix form. The data lines D1 to Dm are electrically insulated from the gate lines G1 to Gn.

Although not shown in FIG. 1, each sub-pixel PX includes a switching transistor connected to a corresponding data line among the data lines D1 to Dm and a corresponding gate line among the gate lines G1 to Gn, a liquid crystal capacitor connected to the switching transistor, and a storage capacitor connected to the switching transistor.

The timing controller 120 receives an image signal RGB and a control signal CTRL, such as, for example, a vertical synchronization signal, a horizontal synchronization signal, a main clock signal, and a data enable signal. The timing controller 120 applies a data signal DATA, which is obtained by processing the image signal RGB according to an operating condition of the display panel 110 on the basis of the control signal CTRL, and a first control signal CONT1 to the data driver 130 and applies a second control signal CONT2 to the gate driver 150. The first control signal CONT1 includes a horizontal synchronization start signal, a clock signal, and a line latch signal TP, and the second control signal CONT2 includes a vertical synchronization start signal, an output enable signal, and first and second gate pulse signals.

The data driver 130 outputs a gray scale voltage in response to the data signal DATA and the first control signal CONT1 to drive the data lines d1 to Dm.

The voltage generator 140 outputs first and second gate-on voltages VON1 and VON2, a gate-off voltage VOFF, and a common voltage VCOM in response to first and second kickback signals KB1 and KB2 and a voltage level signal VD from the timing controller 120. The first kickback signal KB1 from the timing controller 120 is used to control a kickback voltage of odd-numbered gate lines G1, G3, G5, . . . , Gn, n being an odd number, and the second kickback signal KB2 is used to control a kickback voltage of even-numbered gate lines G2, G4, G6, . . . , Gn−1.

The gate driver 150 drives the gate lines G1 to Gn in response to the second control signal CONT2 from the timing controller 120 and the first and second gate-on voltages VON1 and VON2 from the voltage generator 140. The gate driver 150 includes a gate driving integrated circuit ("IC"). In one embodiment, the gate driving IC may be embodied in an amorphous silicon gate ("ASG") circuit using an amorphous silicon thin film transistor ("a-Si TFT").

When one of the first and second gate-on voltages VON1 and VON2 is applied to one of the gate lines, switching transistors, connected to a corresponding gate line and arranged in a row, are turned on and the data driver 130 applies gray scale voltages corresponding to the data signal DATA to the data lines D1 to Dm. The gray scale voltages applied to the data lines D1 to Dm are provided to corresponding sub-pixels, respectively, through the turned-on switching transistors. In this case, a time period during which the switching transistors arranged in a row are turned on, that is, one period of the data enable signal and the first and second gate clock signals is called one horizontal period or 1H. According to an exemplary embodiment, a gate line pre-charge driving method may be used such that the first gate-on voltage VON1 or the second gate-on voltage VON2 is applied to one gate line during a period of H/2 and overlapped with the second gate-on voltage VON2 or the first gate-on voltage VON1 applied to a previous gate line during a later period of H/2. The gate line pre-charge driving method may compensate for a reduced charging time of the liquid crystal capacitor, which is caused by an increased number of the gate lines.

Figure 2:
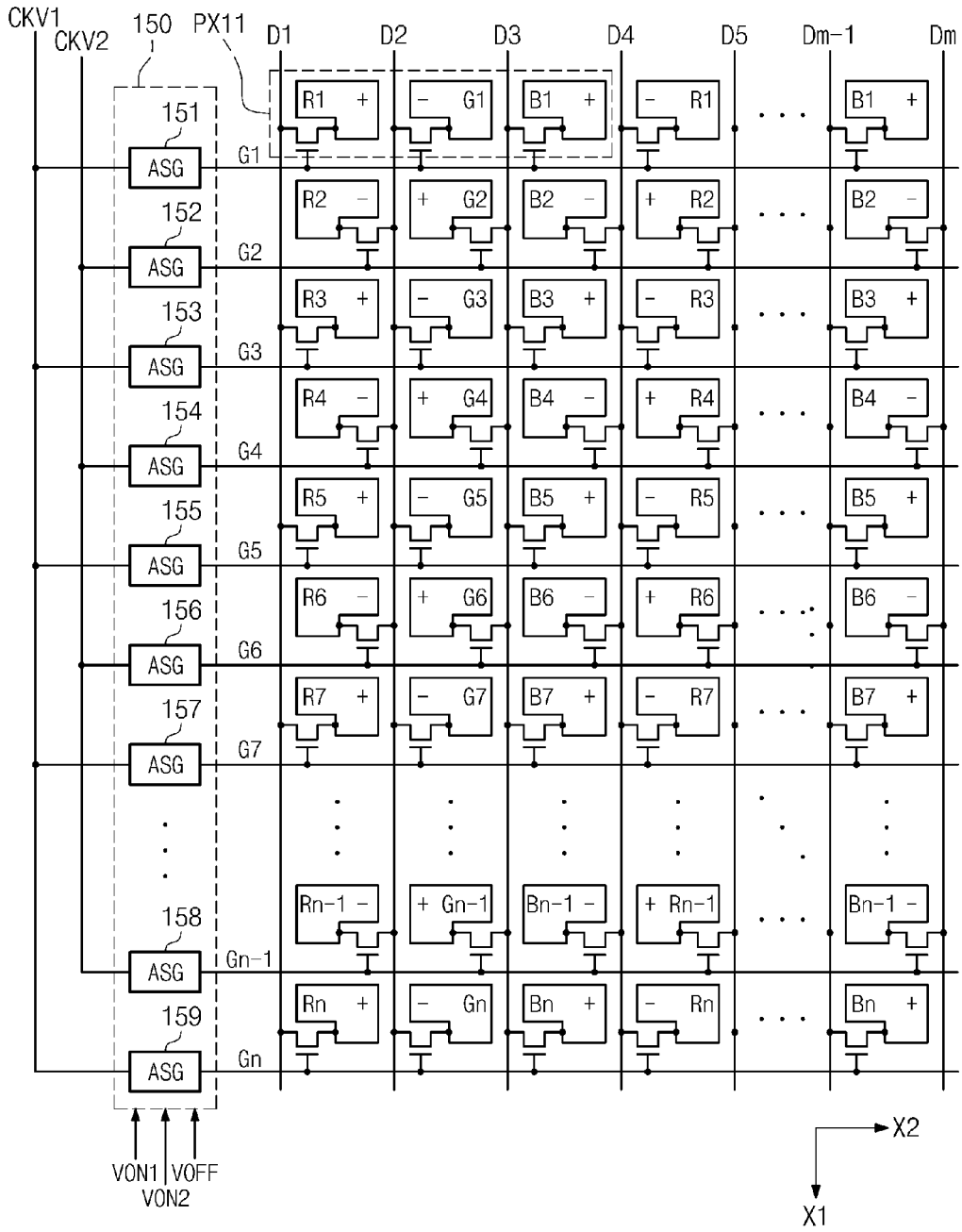
FIG. 2 is a circuit diagram showing a configuration of a gate driver and an arrangement of pixels in a display panel shown in FIG. 1.

FIG. 2 is a circuit diagram showing a configuration of the gate driver and an arrangement of the pixels in the display panel shown in FIG. 1.

Referring to FIG. 2, the gate driver 150 includes a plurality of ASG circuits 151 to 157, . . . , 158 and 159 respectively corresponding to the gate lines G1 to Gn. In FIG. 2, the gate driver 150 is configured to include the ASG circuits 151 to 157, . . . , 158 and 159, but the invention should not be construed as being limited thereto or thereby. In an alternative embodiment, for example, the gate driver 150 may be embodied in an integrated circuit and mounted on the display panel 110.

A pixel PX11 of the display panel 110 includes three sub-pixels R1, G1, and B1 respectively corresponding to red, green, and blue colors and switching transistors respectively connected to the three sub-pixels R1, G1, and B1. Each switching transistor is connected to a corresponding data line among the data lines D1 to Dm and a corresponding gate line among the gate lines G1 to Gn. The sub-pixels R1, G1, and B1 are arranged in the second direction X2 in which the gate lines G1 to Gn are extended, and the sub-pixels having the same color are arranged in the first direction X1 in which the data lines D1 to Dm are extended. In an exemplary embodiment, red sub-pixels R1 to Rn are disposed at a right side of the data line D1, green sub-pixels G1 to Gn are disposed between the data lines D2 and D3, and blue sub-pixels B1 to Bn are disposed between the data lines D3 and D4. In an exemplary embodiment, the sub-pixels are arranged in the second direction X2 in an order of red, green, and blue colors, but the invention should not be construed as being limited thereto or thereby. That is, the sub-pixels may be arranged, for example, in an order of R-B-G, G-B-R, G-R-B, B-R-G, or B-G-R.

Referring to FIG. 2, a first group of sub-pixels R1 to Rn, G1 to Gn, and B1 to Bn are connected to a data line disposed at a left side thereof (hereinafter, referred to as left-side data line) and a second group of the sub-pixels R1 to Rn, G1 to Gn, and B1 to Bn are connected to a data line disposed at a right side thereof (herein after, referred to as right-side data line). In detail, switching transistors of sub-pixels connected to the odd-numbered gate lines G1, G3, G5, . . . , Gn, n being an odd number, are connected to the left-side data line, and switching transistors of sub-pixels connected to the even-numbered gate lines G2, G4, G6, . . . , Gn−1 are connected to the right-side data line. That is, the sub-pixels are alternately connected to the left-side data line and the right-side data line, i.e., in a zigzag pattern, in a column direction.

In an exemplary embodiment, the switching transistors of the sub-pixels connected to the gate line G1 are connected to the left-side data line and the switching transistors of the sub-pixels connected to the gate line G2 are connected to the right-side data line.

The data lines D1 to Dm need to be driven in a column inversion mode in order to drive the gate lines G1 to Gn in the pre-charge driving method described above. According to the column inversion mode, the sub-pixels connected to the same data line are applied with a gray scale voltage of the same polarity and the sub-pixels connected to adjacent data lines are applied with gray scale voltages of polarities complementary to each other with respect to the common voltage VCOM. The polarity of the gray scale voltages applied to the data lines is changed for each frame.

According to a connection relationship between the sub-pixels and the data lines, as described above, although the data lines are driven in the column inversion mode by the data driver 140, an apparent inversion on the display screen can be a dot inversion. In other words, the gray scale voltages applied to adjacent sub-pixels have complementary polarities to each other. In a case where the apparent inversion is the dot inversion, a brightness difference due to a kickback voltage between when the gray scale voltage is a positive (+) polarity and when the gray scale voltage is a negative (−) polarity is reduced, and thus a vertical flicker may be reduced.

Hereinafter, an operation of the display panel 110 will be described in detail in a case where a data signal at a lowest gray scale value is applied to the red sub-pixels R1 to Rn and a data signal at a highest gray scale value is applied to the green sub-pixels G1 to Gn and the blue sub-pixels B1 to Bn in the pixel structure shown in FIG. 2.

Figure 3:
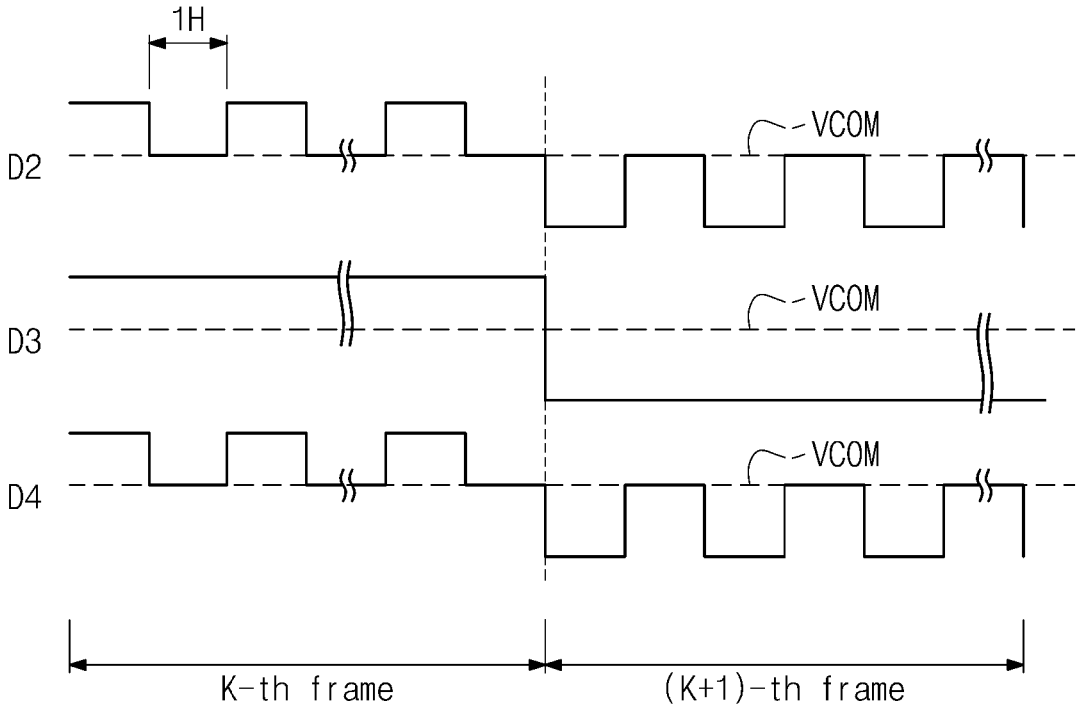
FIG. 3 is a timing diagram showing an exemplary embodiment of an operation of a display panel shown in FIG. 2.

FIG. 3 is a timing diagram showing an exemplary embodiment of an operation of the display panel shown in FIG. 2.

Referring to FIGS. 2 and 3, when the data signal at the highest gray scale value is applied to the green sub-pixels G1 to Gn and the blue sub-pixels B1 to Bn and the data signal at the lowest gray scale value is applied to the red sub-pixels R1 to Rn, the data signal corresponding to the highest gray scale value and the data signal corresponding to the lowest gray scale value are alternately applied every horizontal period 1H to the data line D2 to which the red sub-pixels R2, R4, R6, . . . , Rn−1 and the green sub-pixels G1, G3, G5, G7, . . . , Gn are connected.

The data line D3, to which the green sub-pixels G2, G4, G6, . . . , Gn−1 and the blue sub-pixels B1, B3, B5, B7, . . . , Bn are connected, is applied with the data signal corresponding to the highest gray scale value during one frame.

The data signal corresponding to the highest gray scale value and the data signal corresponding to the lowest gray scale value are alternately applied every horizontal period 1H to the data line D4 to which the blue sub-pixels B2, B4, B6, . . . , Bn−1 and the red sub-pixels R1, R3, R5, R7, . . . , Rn are connected.

Therefore, the sub-pixels connected to the data line D3 applied with the voltage having a uniform level during the one frame has brightness brighter than that of the sub-pixels connected to the data lines D2 and D4 applied with the voltage having a level changed every horizontal period H.

That is, the brightness of the sub-pixels B1, G2, B3, G4, B5, G6, B7, . . . , Gn−1, and Bn connected to the data line D3 is higher than the brightness of the green sub-pixels G1, G3, G5, G7, . . . , Gn connected to the data line D2 and the blue sub-pixels B2, B4, B6, . . . , Bn−1 connected to the data line D4. This may cause a mixed color horizontal line phenomenon of the image displayed in the display panel 110, which deteriorates display quality.

Figure 4:
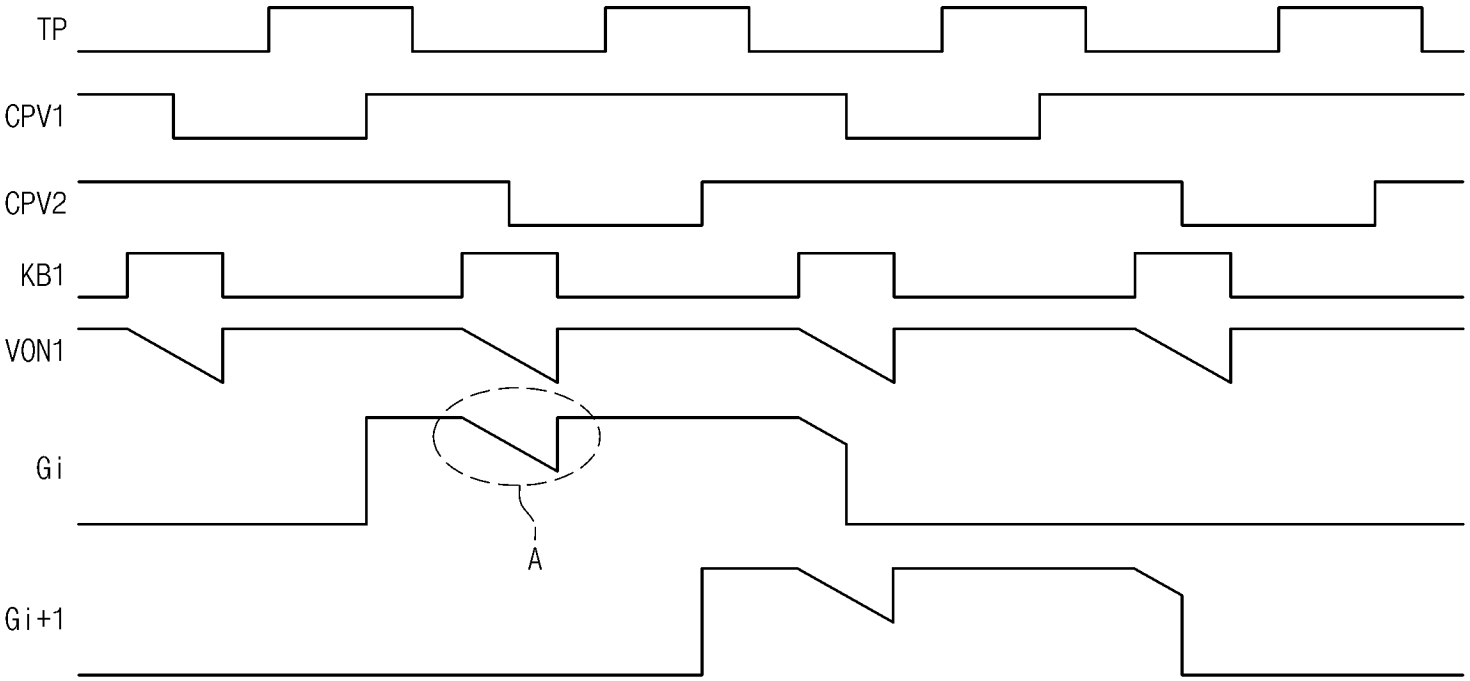
FIG. 4 is a timing diagram showing an exemplary embodiment of an operation of the display apparatus shown in FIG. 1 when a voltage generator shown in FIG. 1 is operated in response to a first kickback signal.

FIG. 4 is a timing diagram showing an exemplary embodiment of an operation of the display apparatus shown in FIG. 1 when the voltage generator shown in FIG. 1 is operated in response to the first kickback signal.

Referring to FIGS. 1 and 4, the voltage generator 140 generates the first gate-on voltage VON1 in response to the first kickback signal KB1 from the timing controller 120. The first gate-on voltage VON1 output from the voltage generator 140 has a level sufficient to turn on the transistors of the sub-pixels connected to a corresponding gate line to which the first gate-on voltage VON1 is applied.

When the first kickback signal KB1 is activated at a high level, the voltage generator 140 controls such that a level of the first gate-on voltage VON1 is lowered at a predetermined slope. The gate driver 150 drives the gate lines G1 to Gn using the first gate-on voltage VON1 and the gate-off voltage VOFF which are from the voltage generator 140. A first gate pulse signal CPV1 included in the second control signal CONT2 from the timing controller 120 is used to drive the odd-numbered gate lines G1, G3, G5, . . . , Gn of the gate lines G1 to Gn and a second gate pulse signal CPV2 included in the second control signal CONT2 from the timing controller 120 is used to drive the even-numbered gate lines G2, G4, G6, . . . , Gn−1. Pulses of the first gate pulse signal CPV1 correspond to the odd-numbered gate lines G1, G3, G5, . . . , Gn, respectively, and pulses of the second pulse signal CPV2 correspond to the even-numbered gate lines G2, G4, G6, . . . , Gn−1. respectively. A line latch signal TP included in the first control signal CONT1 provided to the data driver 130 indicates a driving timing of the data line D1 to Dm by the data driver 130.

When the first gate pulse signal CPV1 is activated at a high level, a predetermined gate line Gi is driven by the first gate-on voltage VON1, and when the first gate pulse signal CPV1 is inactivated at a low level, the predetermined gate line Gi is driven by the gate-off voltage VOFF. A gate line Gi+1 is driven by the first gate-on voltage VON1 when the second gate pulse signal CPV2 is activated at a high level and driven by the gate-off voltage VOFF when the second gate pulse CPV2 is inactivated at a low level.

The first kickback signal KB1 is used to decrease the level of the first gate-on voltage VON1 at a falling edge of the first gate-on voltage VON1, i.e., when the transistors of the sub-pixels connected to one gate line are turned off a predetermined time after the sub-pixels are turned on. Therefore, the first kickback signal KB1 is required to have a frequency two times higher than that of the first and second gate pulse signals CPV1 and CPV2, so that the voltage level of the first gate-on voltage VON1 applied to the gate lines G1 to Gn may be decreased at a falling edge thereof.

However, a voltage drop may occur in a portion "A" of FIG. 4 during when the gate lines G1 to Gn are driven by the first gate-on voltage VON1. Since the voltage drop causes a decrease of a charge amount in each sub-pixel, the mixed color horizontal line phenomenon on the image may become more noticeable.

Figure 5:
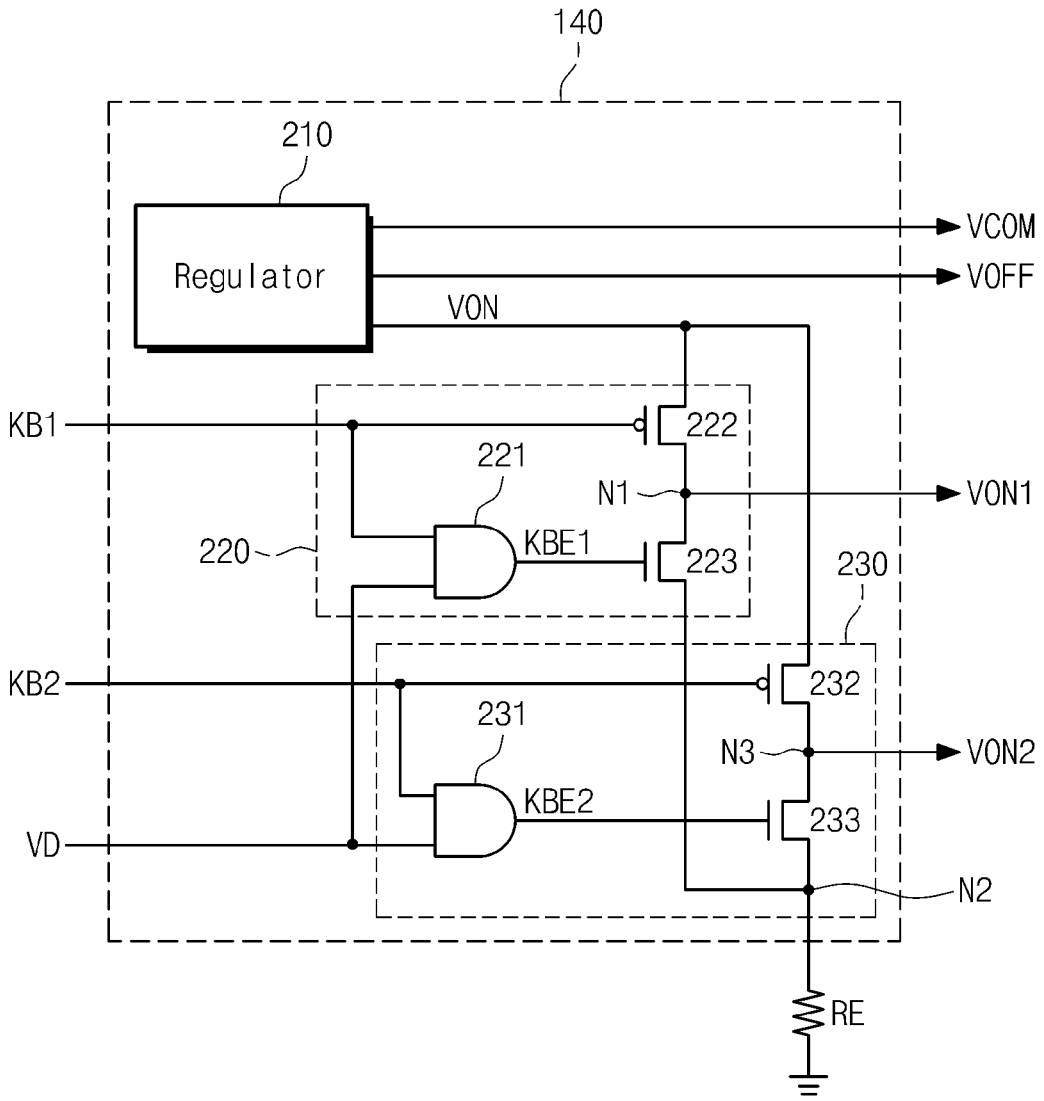
FIG. 5 is a circuit diagram showing an exemplary embodiment of the voltage generator shown in FIG. 1 according to the invention.

FIG. 5 is a circuit diagram showing an exemplary embodiment of the voltage generator shown in FIG. 1 according to the invention.

Referring to FIG. 5, the voltage generator 140 includes a regulator 210, a first gate-on voltage generator 220, a second gate-on voltage generator 230, and a resistor RE.

The regulator 210 generates the common voltage VCOM, the gate-off voltage VOFF, and the gate-on voltage VON. The common voltage VCOM and the gate-off voltage VOFF generated by the regulator 210 are applied to the gate driver 150 shown in FIG. 1.

The first gate-on voltage generator 220 includes a first logic circuit 221 and first and second transistors 222 and 223. The first logic circuit 221 receives the first kickback signal KB1 and the voltage level signal VD from the timing controller 120 shown in FIG. 1 and outputs a first kickback enable signal KBE1. In an exemplary embodiment, the first logic circuit 221 is configured to include an AND gate.

The first transistor 222 is connected between the gate-on voltage VON generated by the regulator 210 and a first node N1 and has a gate controlled by the first kickback signal KB1. The second transistor 223 is connected between the first node N1 and a second node N2 and has a gate controlled by the first kickback enable signal KBE1 output from the first logic circuit 221.

The second gate-on voltage generator 230 includes a second logic circuit 231 and third and fourth transistors 232 and 233. The second logic circuit 231 receives the second kickback signal KB2 and the voltage level signal VD from the timing controller 120 shown in FIG. 1 and outputs a second kickback enable signal KBE2. In an exemplary embodiment, the second logic circuit 231 is configured to include an AND gate.

The third transistor 232 is connected between the gate-on voltage VON generated by the regulator 210 and a third node N3 and has a gate controlled by the second kickback signal KB2. The fourth transistor 233 is connected between the third node N3 and the second node N2 and has a gate controlled by the second kickback enable signal KBE2 output from the second logic circuit 231. A voltage at the third node N3 is output as the second gate-on voltage VON2.

In an exemplary embodiment, each of the first and third transistors 222 and 232 is configured to include a P-channel metal oxide semiconductor ("PMOS") transistor and each of the second and fourth transistors 223 and 233 is configured to include an N-channel metal oxide semiconductor ("NMOS") transistor. The resistor RE is connected between the second node N2 and a ground voltage.

Hereinafter, an operation of the voltage generator 140 will be described in detail with reference to FIG. 6.

Figure 6:
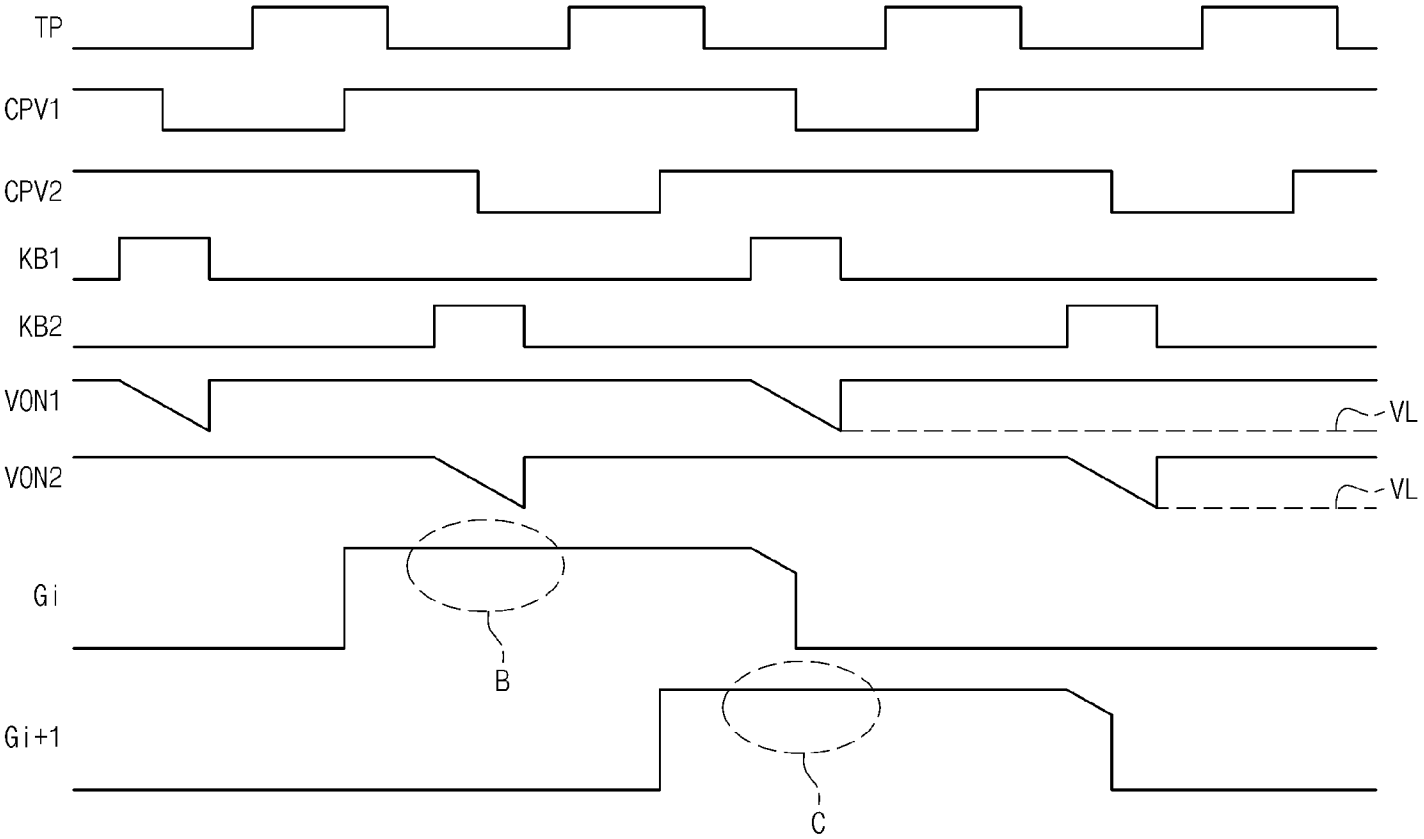
FIG. 6 is a timing diagram showing an exemplary embodiment of an operation of the display apparatus shown in FIG. 1 and an operation of the voltage generator shown in FIG. 5.

FIG. 6 is a timing diagram showing an exemplary embodiment of the operation of the display apparatus shown in FIG. 1 and the operation of the voltage generator shown in FIG. 5.

Referring to FIG. 6, the first kickback signal KB1 and the second kickback signal KB2, which are output from the timing controller 120, have the same frequency and different phases from each other. Frequencies of the first and second kickback signals KB1 and KB2 are the same as those of the first and second gate pulse signals CPV1 and CPV2, respectively. The voltage level signal VD corresponds to a lowest voltage VL of the first and second gate-on voltages VON1 and VON2.

When the first kickback signal KB1 has a low level, the first transistor 222 is turned on and a voltage at the first node N1 increases to the level of the gate-on voltage VON output from the regulator 210. Therefore, the first gate-on voltage VON1 is output at the level of the gate-on voltage VON of the first node N1. When the first kickback signal KB1 is activated to a high level, the first transistor 222 is turned off. When the first kickback signal KB1 has the high level and the voltage level signal VD has the high level, the first logic circuit 221 outputs the first kickback enable signal KBE1 at the high level. Accordingly, the second transistor 223 is turned on. Thus, the first gate-on voltage VON1 having a level of the voltage at the first node N1 is discharged through the resistor RE. In this case, a discharge speed of the first gate-on voltage VON1 depends on a resistance of the resistor RE.

When the first kickback signal KB1 is transited to the low level, the first transistor 222 is turned on and the second transistor 223 is turned off. Thus, the first gate-on voltage VON1 is output at the level of the gate-on voltage VON again.

When the second kickback signal KB2 has a low level, the third transistor 232 is turned on and a voltage at the third node N3 increases to the level of the gate-on voltage VON output from the regulator 210. Therefore, the second gate-on voltage VON2 is output at the level of the gate-on voltage VON of the third node N3. When the second kickback signal KB2 is activated to a high level, the third transistor 232 is turned off. When the second kickback signal KB2 has the high level and the voltage level signal VD has the high level, the second logic circuit 231 outputs the second kickback enable signal KBE2 at the high level. Accordingly, the fourth transistor 233 is turned on. Thus, the second gate-on voltage VON2 having the level of the voltage at the third node N3 is discharged through the resistor RE. In this case, a discharge speed of the second gate-on voltage VON2 depends on the resistance of the resistor RE.

When the second kickback signal KB2 is transited to the low level, the third transistor 232 is turned on and the fourth transistor 233 is turned off. Thus, the second gate-on voltage VON2 is output at the level of the gate-on voltage VON again.

The gate driver 150 shown in FIG. 1 drives the odd-numbered gate lines G1, G3, G5, . . . , Gn using the first gate-on voltage VON1 in response to the first gate pulse signal CPV1 and drives the even-numbered gate lines G2, G4, G6, . . . , Gn−1 using the second gate-on voltage VON2 in response to the second gate pulse signal CPV2.

As described above, since the voltage generator 140 separately generates the first gate-on voltage VON1 corresponding to the odd-numbered gate lines G1, G3, G5, . . . , Gn and the second gate-on voltage VON2 corresponding to the even-numbered gate lines G2, G4, G6, . . . , Gn−1. the voltage drop does not occur in portions "B" and "C" of FIG. 6 during when the gate lines G1 to Gn are driven by the first and the second gate-on voltages VON1 and VON2, which is different from in the period A shown in FIG. 4. As a result, the display quality of the display apparatus 100 may be effectively prevented from being deteriorated.

Figure 7:
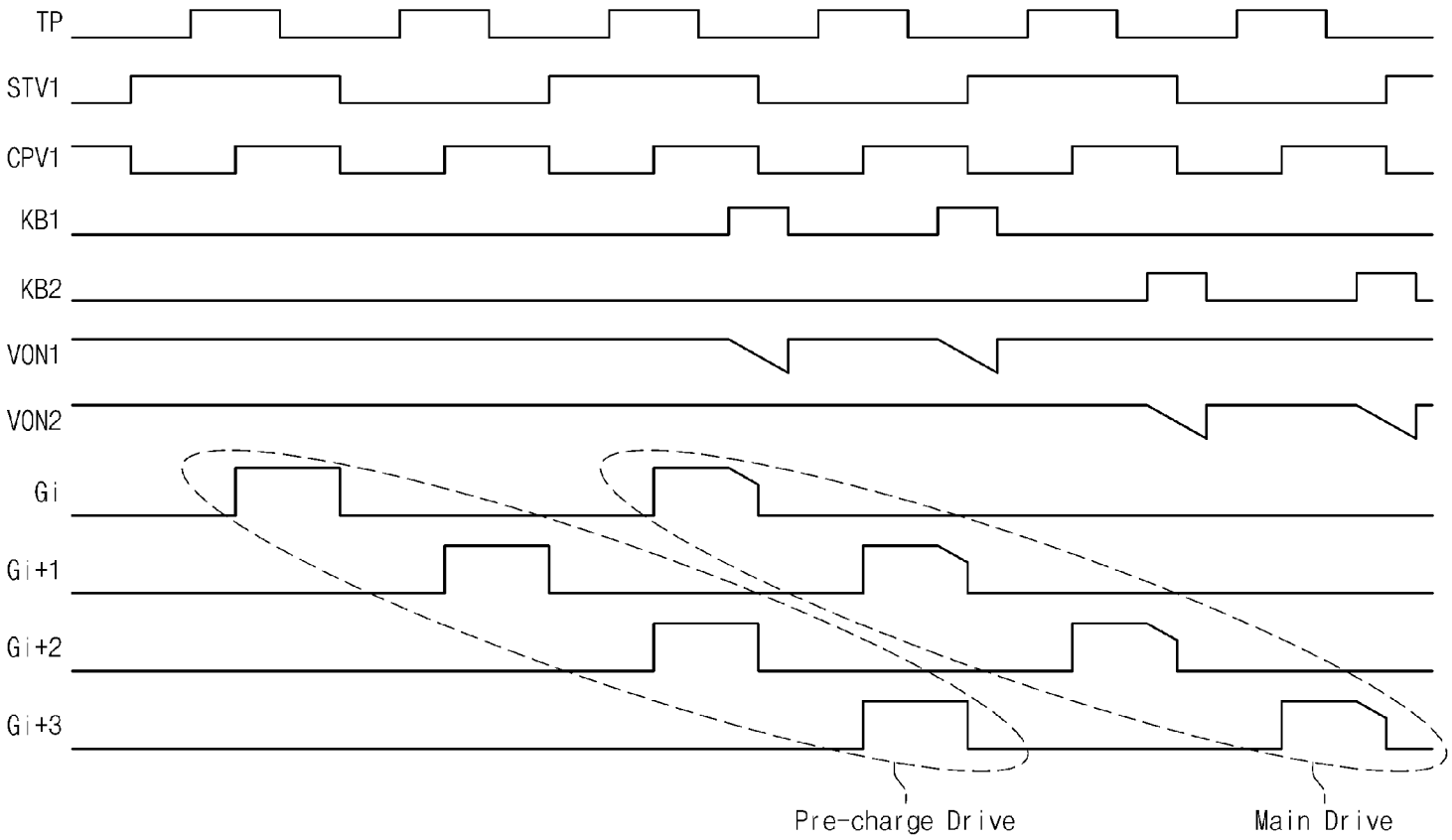
FIG. 7 is a timing diagram showing another exemplary embodiment of an operation of a display apparatus shown in FIG. 1 according to the invention.

FIG. 7 is a timing diagram showing another exemplary embodiment of the operation of the display apparatus shown in FIG. 1 according to the invention.

Referring to FIGS. 1 and 7, one gate line is driven twice, in a pre-charge drive mode and in a main drive mode, in one frame period in response to a vertical synchronization start signal STV1. In other words, one gate line is driven for pre-charging a corresponding data line connected thereto and then driven for applying a gray scale voltage to the corresponding data line, during one frame period. In detail, an (i+2)-th gate line Gi+2 is driven in the pre-charge drive mode when an i-th gate line Gi is driven in the main drive mode, and an (i+3)-th gate line Gi+3 is driven in the pre-charge drive mode when an (i+1)-th gate line Gi+1 is driven in the main drive mode. In the pre-charge driving, an amount of charge on the (i+2)-th gate line is increased by the driving of the i-th gate line Gi in the main drive mode. In an exemplary embodiment, i is in a form of (4k+1), wherein k is an integer in a range of 0 to (n/4−1).

The voltage generator 140 generates the first gate-on voltage VON1 in response to the first kickback signal KB1 to drive the gate lines Gi and Gi+1 and the second gate-on voltage VON2 in response to the second kickback signal KB2 to drive the gate lines Gi+2 and Gi+3.

Responsive to the second control signal CONT2, i.e., the vertical synchronization start signal STV1 and the first gate pulse signal CPV1, output from the timing controller 120, the gate driver 150 drives the gate lines Gi and Gi+1 using the first gate-on voltage VON1 and the gate-off voltage VOFF and drives the gate lines Gi+2 and Gi+3 using the second gate-on voltage VON2 and the gate-off voltage VOFF.

As shown in FIG. 7, when driving the gate lines G1 to Gn, a voltage level of the gate lines G1 to Gn is decreased at a falling edge, at which the voltage level of the gate lines G1 to Gn is transited to the level of the gate-off voltage VOFF from the level of the gate-on voltage VON, so as to reduce the kickback voltage. In this case, since the first gate-on voltage VON1 for driving the i-th gate line Gi and the second gate-on voltage VON2 for pre-charge driving the (i+2)-th gate line Gi+2 are separated from each other, no voltage drop occurs at a falling edge of a gate signal for pre-charge driving the (i+2)-th gate line Gi+2. Thus, the display quality of the display apparatus 100 may be effectively prevented from being degraded.

Figure 8:
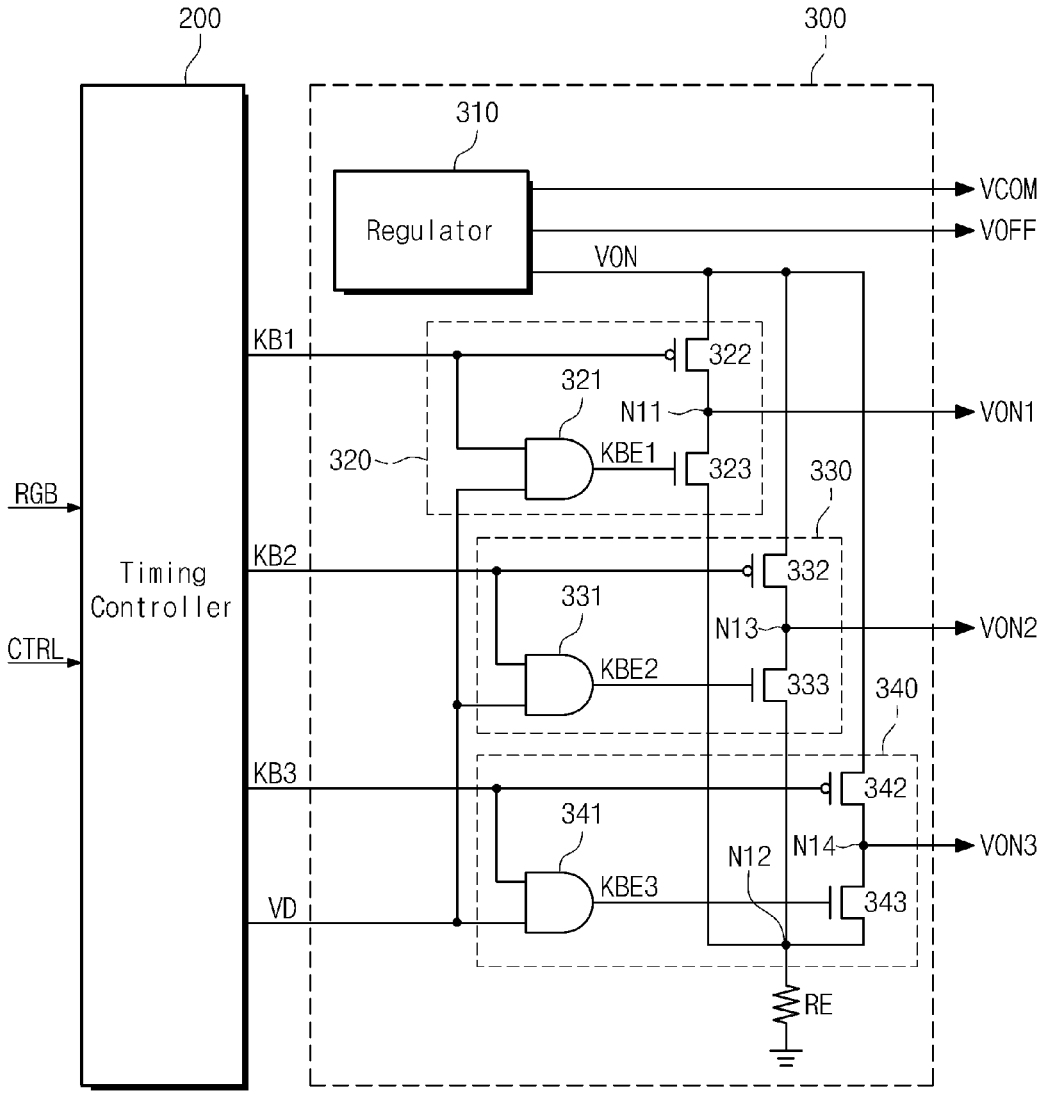
FIG. 8 is a circuit diagram showing another exemplary embodiment of a timing controller and a voltage generator shown in FIG. 1 according to the invention.

FIG. 8 is a circuit diagram showing another exemplary embodiment of a timing controller and a voltage generator shown in FIG. 1 according to the invention.

Referring to FIG. 8, a timing controller 200 outputs first, second, and third kickback signals KB1, KB2, and KB3, which is different from the timing controller 120 shown in FIG. 1. A voltage generator 300 outputs first, second, and third gate-on voltages VON1, VON2, and VON3, a common voltage VCOM, and a gate-off voltage VOFF in response to the first to third kickback signals KB1, KB2, and KB3 and a voltage level signal VD. Although not shown in FIG. 8, the second control signal CONT2 applied to the gate driver 150 shown in FIG. 1 from the timing controller 200 includes first, second, and third gate pulse signals.

The voltage generator 300 includes a regulator 310, a first gate-on voltage generator 320, a second gate-on voltage generator 330, a third gate-on voltage generator 340, and a resistor RE.

The regulator 310 generates the common voltage VCOM, the gate-off voltage VOFF, and a gate-on voltage VON. The gate-off voltage VOFF and the gate-off voltage VOFF generated by the regulator 310 are applied to the gate driver 150 shown in FIG. 1.

The first gate-on voltage generator 320 includes a first logic circuit 321 and first and second transistors 322 and 323. The first logic circuit 321 receives the first kickback signal KB1 and the voltage level signal VD from the timing controller 200 and outputs a first kickback enable signal KBE1. In an exemplary embodiment, the first logic circuit 321 is configured to include an AND gate.

The first transistor 322 is connected between the gate-on voltage VON generated by the regulator 310 and a first node N11 and includes a gate controlled by the first kickback signal KB1. The second transistor 323 is connected between the first node N11 and a second node N12 and includes a gate controlled by the first kickback signal KBE1 output from the first logic circuit 321. The voltage at the first node N11 is output as the first gate-on voltage VON1.

The second gate-on voltage generator 330 includes a second logic circuit 331 and third and fourth transistors 332 and 333. The second logic circuit 331 receives the second kickback signal KB2 and the voltage level signal VD from the timing controller 200 and outputs a second kickback enable signal KBE2. In an exemplary embodiment, the second logic circuit 321 is configured to include an AND gate.

The third transistor 332 is connected between the gate-on voltage VON generated by the regulator 310 and a third node N13 and includes a gate controlled by the second kickback signal KB2. The fourth transistor 333 is connected between the third node N13 and the second node N12 and includes a gate controlled by the second kickback signal KBE2 output from the second logic circuit 331. The voltage at the third node N13 is output as the second gate-on voltage VON2.

The third gate-on voltage generator 340 includes a third logic circuit 341 and fifth and sixth transistors 342 and 343. The third logic circuit 341 receives the third kickback signal KB3 and the voltage level signal VD from the timing controller 200 and outputs a third kickback enable signal KBE3. In an exemplary embodiment, the third logic circuit 341 is configured to include an AND gate.

The fifth transistor 342 is connected between the gate-on voltage VON generated by the regulator 310 and a fourth node N14 and includes a gate controlled by the third kickback signal KB3. The sixth transistor 343 is connected between the fourth node N14 and the second node N12 and includes a gate controlled by the third kickback signal KBE3 output from the third logic circuit 341. The voltage at the fourth node N14 is output as the third gate-on voltage VON3.

In an exemplary embodiment, each of the first, third, and fifth transistors 322, 332, and 342 is configured to include a PMOS transistor, and each of the second, fourth, and sixth transistors 323, 333, and 343 is configured to include an NMOS transistor. The resistor RE is connected between the second node N12 and the ground voltage.

Hereinafter, an operation of the voltage generator 300 will be described in detail with reference to FIG. 9.

Figure 9:
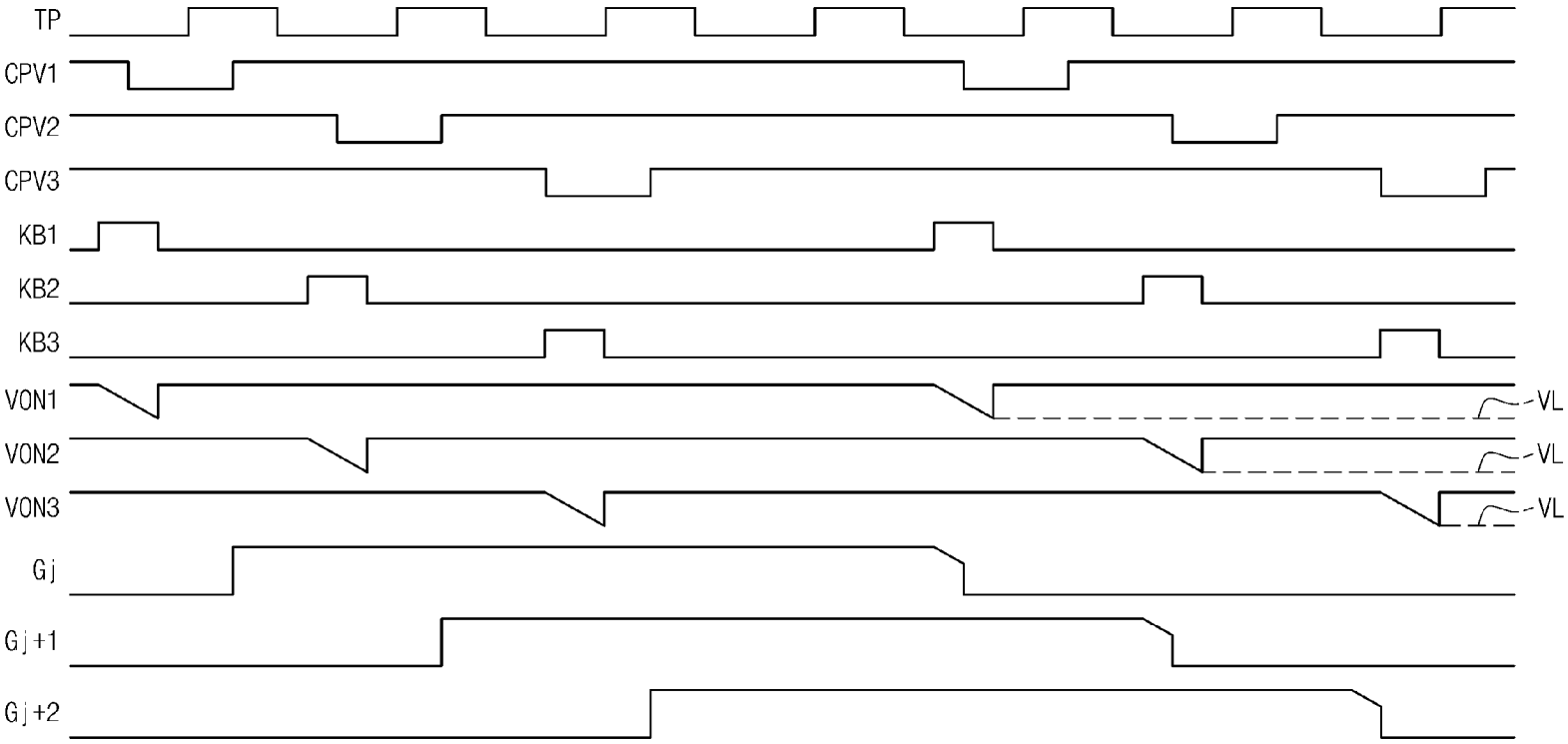
FIG. 9 is timing diagram showing signals used in the timing controller and the voltage generator shown in FIG. 8.

FIG. 9 is timing diagram showing signals used in the timing controller and the voltage generator shown in FIG. 8.

Referring to FIG. 9, the first kickback signal KB1, the second kickback signal KB2, and the third kickback signal KB3, which are output from the timing controller 200, have the same frequency and different phases from each other. Frequencies of the first to third kickback signals KB1 to KB3 are the same as those of first to third gate pulse signals CPV1 to CPV3. The voltage level signal VD corresponds to a lowest voltage level VL of each of the first to third gate-on voltages VON1 to VON3.

When the first kickback signal KB1 has a low level, the first transistor 322 is turned on and a voltage at the first node N11 increases to the level of the gate-on voltage VON output from the regulator 310. Therefore, the first gate-on voltage VON1 is output at the level of the gate-on voltage VON of the first node N11. When the first kickback signal KB1 is activated to a high level, the first transistor 322 is turned off. When the first kickback signal KB1 has the high level and the voltage level signal VD has the high level, the first logic circuit 321 outputs the first kickback enable signal KBE1 at the high level. Accordingly, the second transistor 323 is turned on. Thus, the first gate-on voltage VON1, which is the voltage at the first node N11, is discharged through the resistor RE. In this case, a discharge speed of the first gate-on voltage VON1 depends on a resistance of the resistor RE.

When the first kickback signal KB1 is transited to the low level, the first transistor 322 is turned on and the second transistor 323 is turned off. As a result, the first gate-on voltage VON1 is output at the level of the gate-on voltage VON again.

When the second kickback signal KB2 has a low level, the third transistor 332 is turned on and a voltage at the third node N13 increases to the level of the gate-on voltage VON output from the regulator 310. Therefore, the second gate-on voltage VON2 is output at the level of the gate-on voltage VON of the third node N13. When the second kickback signal KB2 is activated to a high level, the third transistor 332 is turned off. When the second kickback signal KB2 has the high level and the voltage level signal VD has the high level, the second logic circuit 331 outputs the second kickback enable signal KBE2 at the high level. Accordingly, the fourth transistor 333 is turned on. Thus, the second gate-on voltage VON2, which is the voltage at the third node N13, is discharged through the resistor RE. In this case, a discharge speed of the second gate-on voltage VON2 depends on the resistance of the resistor RE.

When the second kickback signal KB2 is transited to the low level, the third transistor 332 is turned on and the fourth transistor 333 is turned off. As a result, the second gate-on voltage VON2 is output at the level of the gate-on voltage VON again.

When the third kickback signal KB3 has a low level, the fifth transistor 342 is turned on and a voltage at the fourth node N14 increases to the level of the gate-on voltage VON output from the regulator 310. Therefore, the third gate-on voltage VON3 is output at the level of the gate-on voltage VON of the fourth node N14. When the third kickback signal KB3 is activated to a high level, the fifth transistor 342 is turned off. When the third kickback signal KB3 has the high level and the voltage level signal VD has the high level, the third logic circuit 341 outputs the third kickback enable signal KBE3 at the high level. Accordingly, the sixth transistor 343 is turned on. Thus, the third gate-on voltage VON3, which is the voltage at the fourth node N14, is discharged through the resistor RE. In this case, a discharge speed of the third gate-on voltage VON3 depends on the resistance of the resistor RE.

When the third kickback signal KB3 is transited to the low level, the fifth transistor 342 is turned on and the sixth transistor 343 is turned off. As a result, the third gate-on voltage VON3 is output at the level of the gate-on voltage VON again.

The gate driver 150 shown in FIG. 1 drives gate lines Gj in response to the first gate pulse signal CPV1 using the first gate-on voltage VON1, drives gate lines Gj+1 in response to the second gate pulse signal CPV2 using the second gate-on voltage VON2, and drives the gate lines Gj+2 in response to the third gate pulse signal CPV3 using the third gate-on voltage VON3. In an exemplary embodiment, j is in a form of in (3k+1), wherein k is an integer in a range of 0 to (n/3−1).

As described above, since the voltage generator 300 separately generates the first, second, and third gate-on voltages VON1, VON2, and VON3 corresponding to the gate lines Gj, Gj+1. and Gj+2. no voltage drop occurs during a period in which the gate lines G1 to Gn are driven by the level of the gate-on voltage VON. Therefore, the display quality of the display apparatus 100 may be effectively prevented from being degraded.

Although the exemplary embodiments of the invention have been described, it is understood that the invention should not be limited to these exemplary embodiments but various changes and modifications can be made by one ordinary skilled in the art within the spirit and scope of the invention as hereinafter claimed.

What is claimed is:

1. A display apparatus comprising:

a plurality of gate lines;

a plurality of data lines which cross the plurality of the gate lines;

a plurality of pixels which is connected to the plurality of the gate lines and the plurality of the data lines;

a data driver which drives the plurality of the data lines;

a gate driver which drives the plurality of the gate lines;

a timing controller which controls the data driver and the gate driver in response to an image signal and a control signal, and outputs a first kickback signal and a second kickback signal; and a voltage generator which outputs a first gate-on voltage in response to the first kickback signal and a second gate-on voltage in response to the second kickback signal, wherein the gate driver drives a first group of the plurality of gate lines in response to the first gate-on voltage and drives a second group of the plurality of gate lines in response to the second gate-on voltage, and wherein the first kickback signal and the second kickback signal are pulse signals, respectively, the first kickback signal and the second kickback signal have the same pulse width, and the first kickback signal has a phase different from a phase of the second kickback signal.

2. The display apparatus of claim 1, wherein the voltage generator generates the first gate-on voltage in response to the first kickback signal and generates the second gate-on voltage in response to the second kickback signal.

3. The display apparatus of claim 1, wherein the voltage generator comprises:

a first gate-on voltage generator which generates the first gate-on voltage in response to the first kickback signal; and a second gate-on voltage generator which generates the second gate-on voltage in response to the second kickback signal.

4. The display apparatus of claim 3, wherein the first gate-on voltage generator further comprises a regulator which generates a third gate-on voltage.

5. The display apparatus of claim 4, wherein the first gate-on voltage generator comprises:

a first logic circuit which receives the first kickback signal and a voltage level signal and outputs a first kickback enable signal;

a first transistor connected between the third gate-on voltage and a first node and including a gate controlled by the first kickback signal; and a second transistor connected between the first node and a second node and including a gate controlled by the first kickback enable signal.

6. The display apparatus of claim 5, wherein the second gate-on voltage generator comprises:

a second logic circuit which receives the second kickback signal and the voltage level signal and outputs a second kickback enable signal;

a third transistor connected between the third gate-on voltage and a third node and including a gate controlled by the second kickback signal; and a fourth transistor connected between the third node and the second node and including a gate controlled by the second kickback enable signal.

7. The display apparatus of claim 6, wherein the timing controller further outputs the voltage level signal.

8. The display apparatus of claim 6, wherein the voltage generator further comprises a resistor connected between the second node and a ground voltage.

9. The display apparatus of claim 1, wherein the first group of the plurality of gate lines comprises odd-numbered gate lines and the second group of the plurality of gate lines comprises even-numbered gate lines.

10. The display apparatus of claim 1, wherein the first kickback signal has a frequency identical to a frequency of the second kickback signal.

11. The display apparatus of claim 1, wherein the plurality of the pixels comprise a red pixel, a green pixel, and a blue pixel, which extend in a direction substantially parallel to the gate lines, a first group of the plurality of pixels is connected to a data line at a left side thereof, and a second group of the plurality of pixels is connected to a data line at a right side thereof.

12. The display apparatus of claim 11, wherein the first group of the plurality of pixels is alternately arranged with the second group of the plurality of pixels in a direction in which the plurality of the data lines extend.

13. The display apparatus of claim 12, wherein the gate lines are driven such that data lines connected to a next gate line are pre-charged when pixels connected to a current gate line are applied with a data signal.

14. A method of driving a display apparatus, the method comprising:

controlling a data driver and a gate driver in response to an image signal and a control signal, and outputting a first kickback signal and a second kickback signal;

outputting a first gate-on voltage in response to the first kickback signal, and outputting a second gate-on voltage in response to the second kickback signal, wherein a first gate lines are driven in response to the first gate-on voltage and a second gate lines are driven in response to the second gate-on voltage, wherein the display apparatus includes:

a plurality of gate lines comprising the first and second gate lines;

a plurality of data lines which cross the plurality of the gate lines;

a plurality of pixels connected to the plurality of the gate lines and the plurality of the data lines;

the data driver which drives the plurality of the data lines; and the gate driver which drives the plurality of the gate lines, and wherein the first kickback signal and the second kickback signal are pulse signals, respectively, the first kickback signal and the second kickback signal have the same pulse width, and the first kickback signal has a phase different from a phase of the second kickback signal.

15. The method of claim 14, wherein the first gate lines comprise odd-numbered gate lines and the second gate lines comprise even-numbered gate lines.

16. The method of claim 14, wherein the outputting the first kickback signal and the second kickback signal comprises:

outputting the first kickback signal having a frequency identical to a frequency of the second kickback signal.

17. The method of claim 14, wherein the plurality of the pixels comprise a red pixel, a green pixel, and a blue pixel, which extend in a direction substantially parallel to the gate lines, and the method further comprising:

connecting a first group of the plurality of pixels to a data line at a left side thereof; and connecting a second group of the plurality of pixels to a data line at a right side thereof.

18. The method of claim 17, further comprising:

alternately arranging the first group of the plurality of pixels and the second group of the plurality of pixels in a direction in which the plurality of the data lines extend.

19. The method of claim 18, further comprising:

driving the plurality of gate lines such that data lines connected to a next gate line are pre-charged when pixels connected to a current gate line are applied with a data signal.

* * * * *